US009296089B2

(12) United States Patent
Schweigert et al.

(10) Patent No.: US 9,296,089 B2
(45) Date of Patent: Mar. 29, 2016

(54) CENTRIC CLAMPING VICE

(71) Applicant: Roehm GmbH, Sontheim/Brenz (DE)

(72) Inventors: Eduard Schweigert, Syrgenstein (DE); Stefan Balletshofer, Hoechstaedt (DE)

(73) Assignee: Roehm GmbH, Sontheim/Brenz (DE)

( * ) Notice: Subject to any disclaimer, the term of this patent is extended or adjusted under 35 U.S.C. 154(b) by 99 days.

(21) Appl. No.: 14/466,015

(22) Filed: Aug. 22, 2014

(65) Prior Publication Data

US 2015/0054210 A1 Feb. 26, 2015

(30) Foreign Application Priority Data

Aug. 22, 2013 (DE) ..... 20 2013 103 810 U

(51) Int. Cl.
*B25B 1/10* (2006.01)
*B25B 1/02* (2006.01)
*B25B 1/24* (2006.01)

(52) U.S. Cl.
CPC . *B25B 1/02* (2013.01); *B25B 1/103* (2013.01); *B25B 1/2405* (2013.01); *B25B 1/2489* (2013.01)

(58) Field of Classification Search
CPC ..... B23Q 1/242; B23Q 1/42; B25B 1/00; B25B 1/02; B25B 1/06; B25B 1/10; B25B 5/00; B25B 5/02; B25B 5/06; B25B 5/10
See application file for complete search history.

(56) References Cited

U.S. PATENT DOCUMENTS 4,529,183 A * 7/1985 Krason ..... B25B 1/103 269/136
4,685,663 A * 8/1987 Jorgensen ..... B25B 1/103 269/244
4,927,126 A * 5/1990 Hoffman ..... B25B 1/103 269/251
4,934,674 A * 6/1990 Bernstein ..... B25B 1/103 269/136
5,098,073 A * 3/1992 Lenz ..... B25B 1/103 269/136
5,330,167 A * 7/1994 Plumb ..... B25B 1/06 269/153
5,595,378 A * 1/1997 Martinsson ..... F16B 2/065 269/152
5,634,253 A * 6/1997 Swann ..... B23Q 3/103 269/136
5,893,551 A * 4/1999 Cousins ..... B25B 1/103 269/136
6,206,354 B1 * 3/2001 Lin ..... B25B 1/103 269/136
6,338,477 B1 * 1/2002 Moore ..... B25B 1/2484 269/251
6,659,439 B1 * 12/2003 Baumgartner ..... B25B 1/12 269/137
7,490,881 B2 * 2/2009 Null ..... B25B 1/18 294/119.1
8,020,877 B2 9/2011 Lang
D685,828 S * 7/2013 Sun ..... D15/140
2010/0013137 A1 * 1/2010 Weller ..... B25B 1/10 269/218
2014/0021667 A1 * 1/2014 Wang ..... B25B 1/103 269/20

FOREIGN PATENT DOCUMENTS

EP 1 946 890 A1 7/2008

* cited by examiner

*Primary Examiner* — Lee D Wilson
*Assistant Examiner* — Tyrone V Hall, Jr.
(74) *Attorney, Agent, or Firm* — Muncy, Geissler, Olds & Lowe, P.C.

(57) ABSTRACT

A centric clamping vice for centric clamping of workpieces is provided that includes a base support having a longitudinal axis, on which a first jaw mount, guided by a first carriage, and a second jaw mount, guided by a second carriage, are adjustably supported along an adjustment path oriented parallel to the longitudinal axis with the aid of a spindle drive. A pair of first slides is assigned to the first carriage, and a pair of second slides is assigned to the second carriage, and the difference between the track width of the first slides and the track width of second slides is greater than the width of second slides.

14 Claims, 7 Drawing Sheets

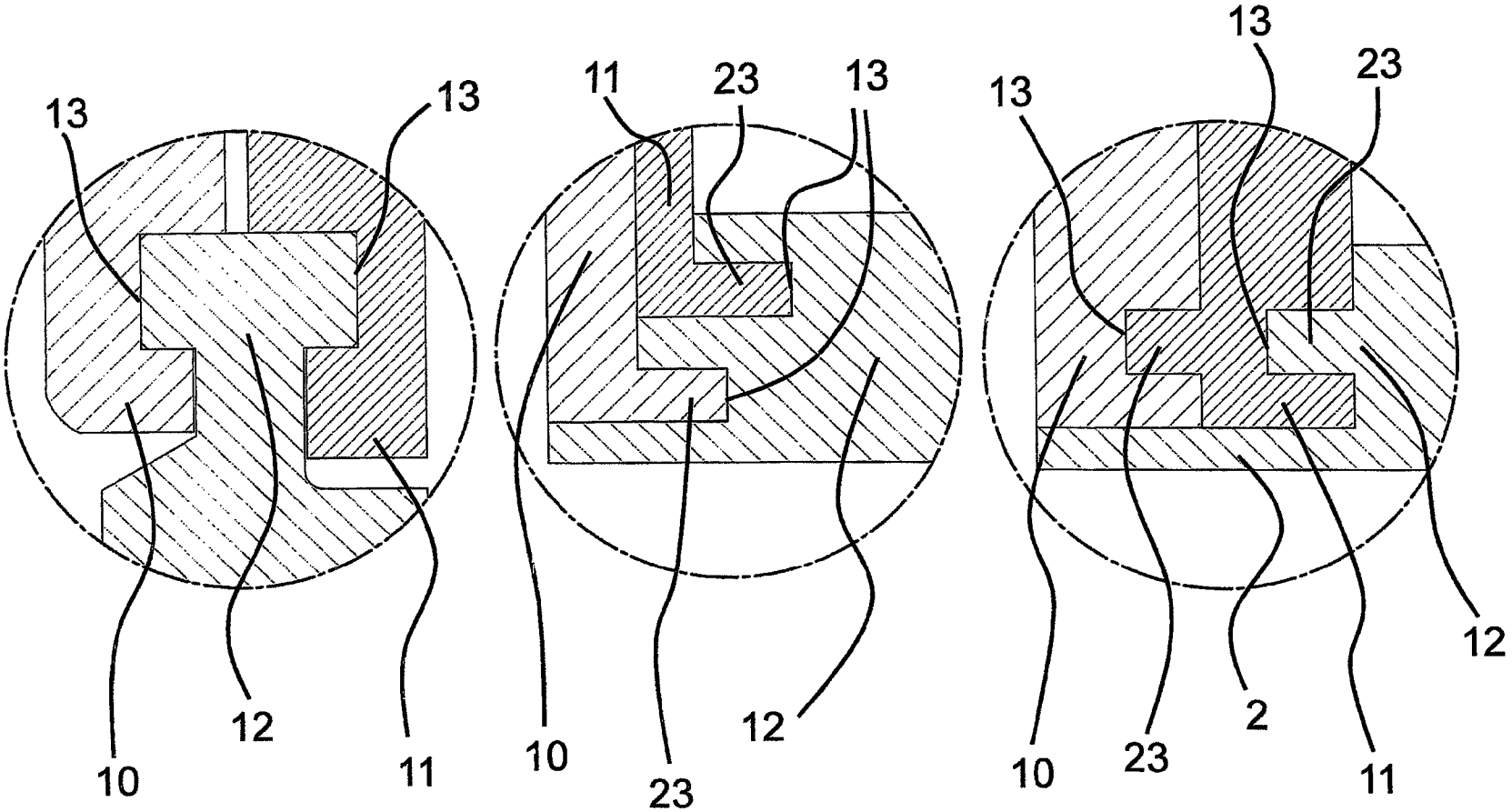
Fig. 7.3
Fig. 7.2
Fig. 7.1

CENTRIC CLAMPING VICE

This nonprovisional application claims priority under 35 U.S.C. §119(a) to German Patent Application No. 20 2013 103 810.5, which was filed in Germany on Aug. 22, 2013, and which is herein incorporated by reference.

BACKGROUND OF THE INVENTION

1. Field of the Invention

The invention relates to a centric clamping vice for centric clamping of workpieces, comprising a base support having a longitudinal axis, on which a first jaw mount, guided by a first carriage, and a second jaw mount, guided by a second carriage, are adjustably supported along an adjustment path oriented parallel to the first longitudinal axis with the aid of a spindle drive.

2. Description of the Background Art

Centric clamping vices are known from the prior art and are illustrated, for example, in EP 1 946 890 A1, which corresponds to U.S. Pat. No. 8,020,877 (B2). In the centric clamping vices according to the prior art, however, it has proven to be disadvantageous that the clamping range provided thereby makes up only a small part of the base support. To ensure a secure clamping of the workpiece to be clamped, a minimum range must namely be provided on the base support for guiding the jaw mounts. This, in turn, results in the fact that the base support of a centric clamping vice which is to have a large clamping range must be given very large dimensions. Thus, centric clamping vices known according to the prior art result in the need to either maintain multiple centric clamping vices having different clamping widths or to use very large base supports.

SUMMARY OF THE INVENTION

It is therefore an object of the present invention to reduce the aforementioned disadvantages and to provide a compact centric clamping vice which has a large clamping range.

This object is achieved in an embodiment, whereby a centric clamping vice having a pair of first slides is assigned to the first carriage, and a pair of second slides is assigned to the second carriage, and the difference between the track width of the first slides and the track width of the second slides is greater than the width of the second slides. In particular, if the first slides and the second slides are oriented facing each other, it is possible to adjust the jaw mounts with respect to each other with the aid of the different track widths, each of which is defined by the distance between the inside surfaces of the slides and the suitable with of the slides, in such a way that the trajectories of the first slides and the second slides do not overlap during the adjustment of the jaw mounts and may thus be guided past each other. It may hereby be easily and effectively ensured that the base support may be given a highly compact design, and workpieces of different sizes may be clamped with the aid of the centric clamping vice according to the present invention.

It has proven to be particularly preferable if a congruent center axis is assigned to the first slides and the second slides. The second slides may thus engage with the first slides when the jaw mounts are brought together, making it possible to easily clamp workpieces of different sizes and—contingent upon the resulting symmetrical configuration—allowing the width of the base support to be provided with a very narrow design. Within the scope of the invention, however, it is also provided that the center axes of the first slides and the second slides are offset with respect to each other.

It has also proven to be advantageous if a pair of rails for guiding the first slides and/or the second slides is assigned to the base support. This makes it possible to guide both the first slides and the second slides directly on the rails. A guided and thus more secure movement sequence of the jaw mounts connected to the slides is facilitated thereby. Within the scope of the invention, however, it is also provided that only the one set of slides is guided on the rails, and the other set of slides, in turn, is guided on the first set of slides. As a result, in particular, an extremely compact base support may be used.

It has furthermore proven to be successful if the first slides are each guided on the side of the rails facing away from the longitudinal axis and if the second slides are each guided on the side of the rails facing the longitudinal axis. As a result, only one pair of rails needs to be provided to guide the first jaw mount and the second jaw mount on the base support.

In this connection, it has also proven to be advantageous if the rails are designed in the shape of a T, and if the first slides and the second slides are assigned guide grooves corresponding to the rails for the purpose of forming a guide contact. The jaw mounts may thus be easily inserted into the rails designed in the shape of a T and then be securely connected to the rails. This effectively reduces the number of translation degrees of freedom to one. Within the scope of the invention, however, it is also provided that the rails have a cross section which deviates from the T-shaped design.

It has also been shown to be advantageous if the spindle drive is provided by a spindle rod which has a first area with a left-hand thread and a second area with a right-hand thread as well as by threaded bushings assigned to the first jaw mount and the second jaw mount. By using a spindle rod which has a first area with a left-hand thread and a second area with a right-hand thread, and due to the corresponding threaded bushings, it is easily and effectively achieved that the first jaw mount is adjusted simultaneously with and in the opposite direction to the second jaw mount when the spindle drive is actuated. In this connection, it has also been shown to be particularly favorable if a receptacle for a tool adjusting the jaw mounts is assigned to the spindle rod. The centric clamping vice according to the invention may thus be easily operated manually, also, the adjustment of the jaw mounts can take place with the assistance of a drive.

The spindle rod can be supported on the base support in a rotatably and axially immobile manner. This achieves the fact that the spindle drive is easily accessible, which has a positive effect on the maintainability of the centric clamping vice according to the invention. It has also been shown to be advantageous if a bearing device situated centrally on the base support is provided for supporting the spindle rod. Due to the central supporting of the spindle rod in the bearing device, the forces which occur during clamping of the workpiece may be easily and effectively diverted via the base support. In addition, only one single bearing unit needs to be provided, due to the central supporting of the spindle rod, which thus has a positive effect on the manufacturing costs of the centric clamping vice according to the invention.

A simplified assembly of the centric clamping vice according to the invention may be implemented, in particular if a plurality of threaded receptacles for receiving screws used to fasten the threaded bushings is assigned to the first jaw mount and/or the second jaw mount. As a result, the threaded bushings may be screwed onto the spindle rod at a later point in time and may then be tightened by the screws in the threaded receptacles provided in the jaw mounts. An easy means of replacing the spindle drive is furthermore provided hereby, so that it may be removed when necessary, due to wear.

At least one of the threaded bushings can be assigned radially oriented elongated holes for aligning the clamping jaws. As a result, the positions of the jaw mounts may be precisely adjusted, since an overlapping of the threaded receptacles with the elongated holes provided in the threaded bushings is now available in a larger area. In this connection, it has also proven to be favorable if the number of threaded receptacles provided in the first jaw mount and/or the second jaw mount corresponds to a multiple of the screws provided for fastening the threaded bushings. More options for connecting the jaw mount to the threaded bushing thus exists, which also facilitates the alignment of the jaw mounts.

To divert the forces acting upon the jaw mounts, areas of the first carriage and the second carriage supporting the slides can be beveled. As a result, the forces acting upon the jaw mounts, which occur during clamping, are diverted into the base support via the slides.

Removable clamping jaws can each be assigned to the first jaw mount and the second jaw mount. The clamping jaws may each be adapted hereby to the workpiece to be clamped. Within the scope of the invention, it is also provided that special clamping contours are assigned to the clamping jaws for the purpose of increasing the clamping security.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein:

FIG. 7.1 shows a detailed view of section VII-VII from FIG. 6, including a first exemplary embodiment of a rail;

FIG. 7.2 shows a detailed view of section VII-VII from FIG. 6, including a second exemplary embodiment of the rail; and FIG. 7.3 shows a detailed view of section VII-VII from FIG. 6, including a third exemplary embodiment of the rail.

DETAILED DESCRIPTION

Figure 1:
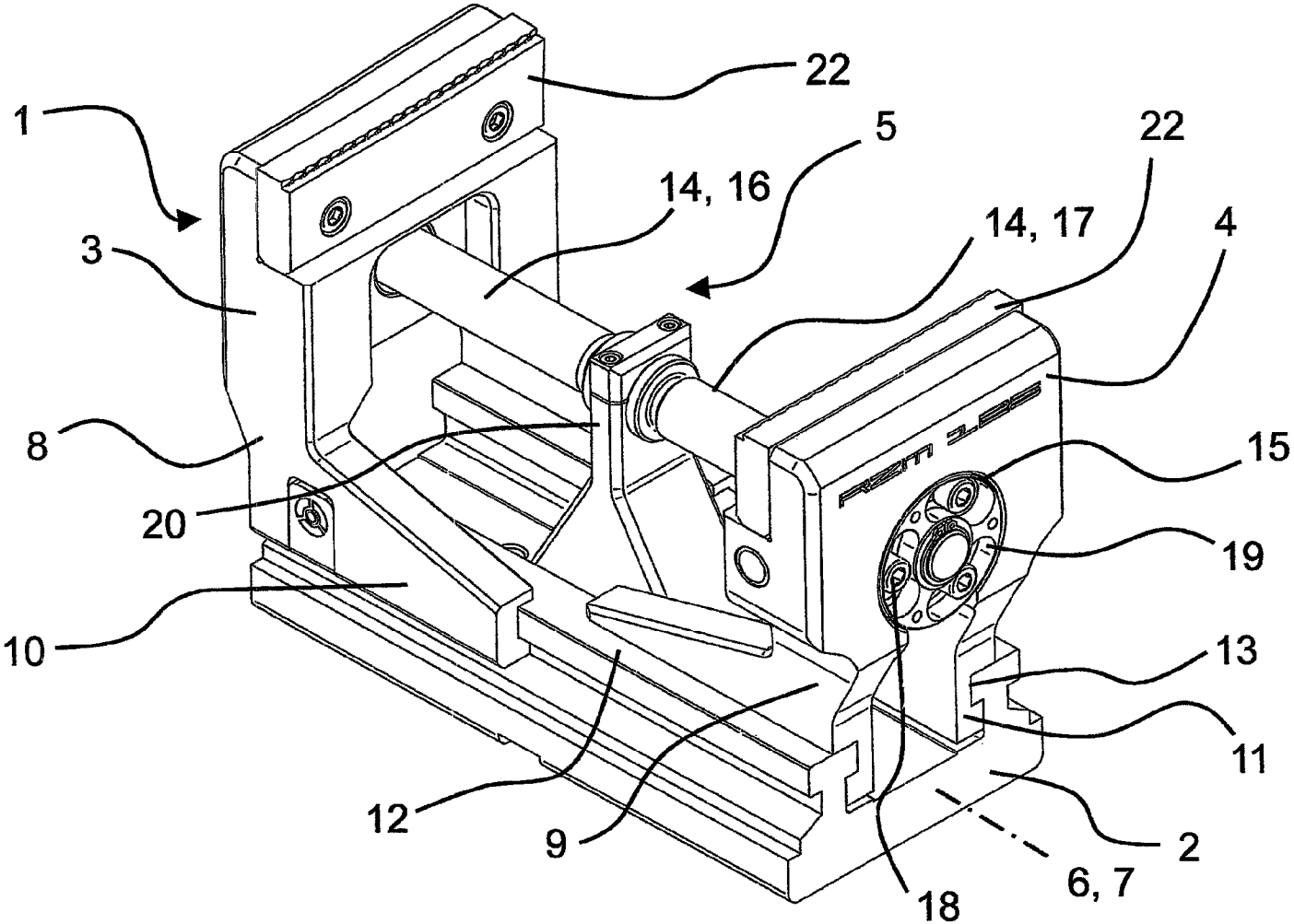
FIG. 1 shows a perspective view of a centric clamping vice which includes separated jaw mounts.
Figure 5:
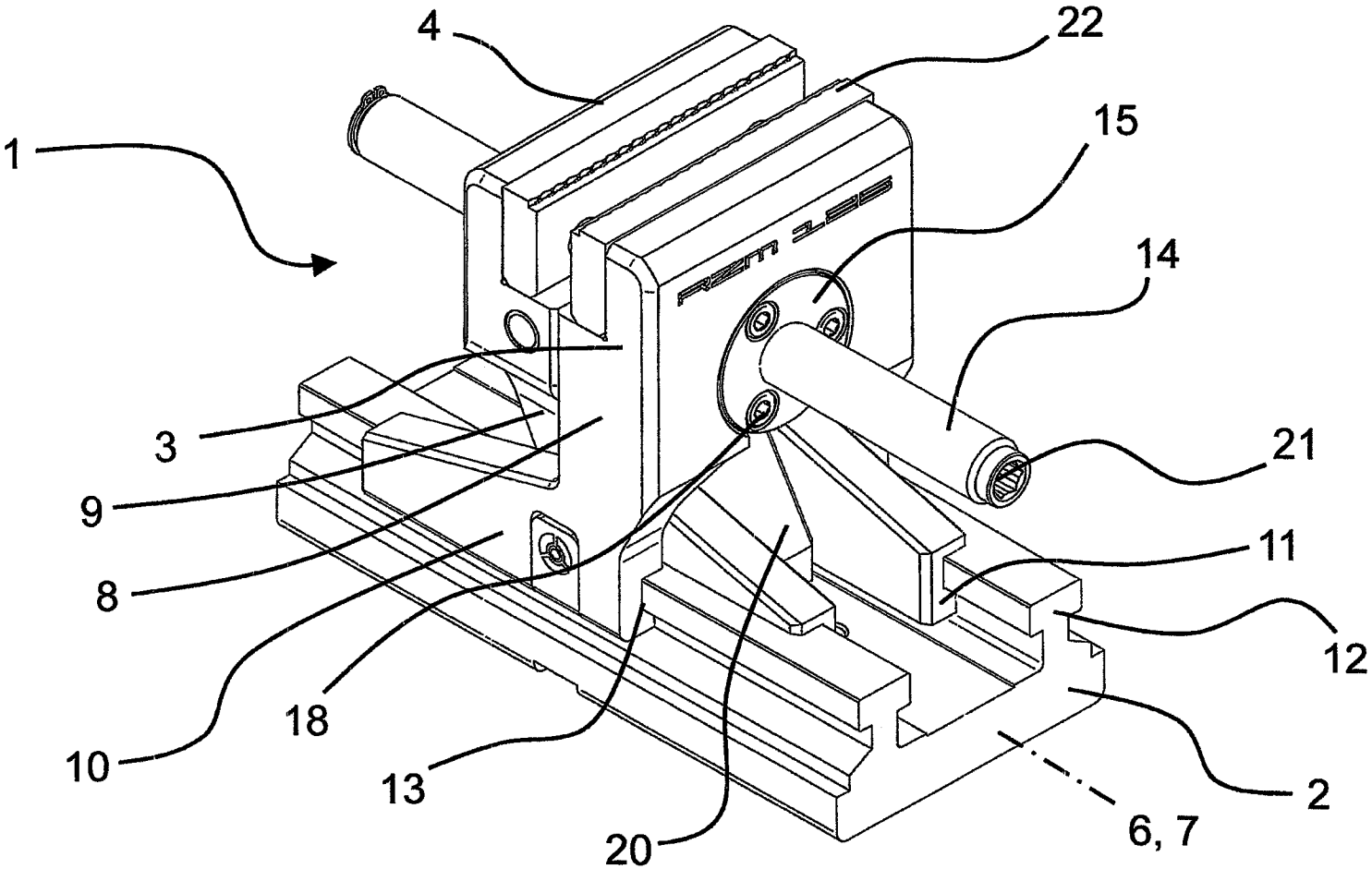
FIG. 5 shows a perspective view of the centric clamping vice, including jaw mounts brought together.

FIG. 1 shows a perspective view of a centric clamping vice 1 according to the invention, comprising a base support 2, on which a first jaw mount 3 and a second jaw mount 4 are adjustably supported along an adjustment path 7 oriented parallel to a longitudinal axis 6 with the aid of a spindle drive 5. First jaw mount 3 is guided on base support 2 by a first carriage 8, and second jaw mount 4 is guided on a second carriage 9. A pair of first slides 10 is assigned to first carriage 8, and a pair of second slides 11 is assigned to second carriage 9, the difference between the track width of first slides 10 and the track width of second slides 11 being greater than the width of second slides 11. The track widths of first slides 10 and second slides 11 are each defined by the distance between slides 10, 11. In the exemplary embodiment illustrated, the center axes of first slides 10 and second slides 11 are also congruent. When adjusting jaw mounts 3, 4 from the open position shown in FIG. 1 to a closed position, which is illustrated in FIG. 5 below, it is now possible for second slides 11 to engage with first slides 10 and thus not obstruct each other. Two T-shaped rails 12, on which first slides 10 and second slides 11 are guided, are assigned to base support 2. First slides 10 are each guided on the side of rails 12 facing away from longitudinal axis 6, and second slides 11 are guided on the side of rails 12 facing longitudinal axis 6. To secure jaw mounts 3, 4 on rails 12, first slides 10 and second slides 11 are each assigned guide grooves 13 for forming a guide contact. Spindle drive 5, which is used to adjust jaw mounts 3, 4, is formed by a spindle rod 14 as well as by threaded bushings 15 assigned to jaw mounts 3, 4. Spindle rod 14 has a first area with a left-hand thread 16 and a second area with a right-hand thread 17. Due to the opposite course of threads 16, 17 provided on spindle rod 14, a simultaneous and opposite adjustment of jaw mounts 3, 4 occurs during the actuation of spindle drive 5.

In the illustrated exemplary embodiment, threaded bushings 15 are screwed with the aid of screws 18 into jaw mounts 3, 4, which are assigned a plurality of threaded receptacles for this purpose, into which screws 18 used for fastening threaded bushings 15 may be screwed. To be able to ensure the orientations and adjustment of jaw mounts 3, 4 in the illustrated exemplary embodiment, elongated holes 19 are provided in threaded bushing 15 assigned to second jaw mount 4, which facilitate a relative rotation between threaded bushing 15 and second jaw mount 4.

To assemble centric clamping vice 1, threaded bushing 15, with its outer thread 25, is first introduced into a jaw mount thread 24 of jaw mount 4. In other words, threaded bushing 15 is screwed to jaw mount 4 with the aid of an outer thread 25 provided on threaded bushing 15, which interacts with jaw mount thread 24 provided as an inner thread. Jaw mount 4 is then set on rails 12, and spindle rod 14 is rotated into threaded bushing 15. Furthermore, screws 18 are inserted into elongated holes 19 and lightly screwed into the threaded receptacles provided in second jaw mount 4 or even pretensioned in such a way that threaded bushing 15 is still able to rotate with respect to jaw mount 4. The fine adjustment then takes place in another step with the aid of elongated holes 19 in threaded bushing 15. For this purpose, threaded bushing 15 is rotated with respect to jaw mount 4 by the desired amount. Screws 18 may now be tightened in elongated holes 19 and in the threaded receptacles provided in second jaw mount 4. Threaded bushing 15 is thus fixedly connected to the second jaw mount.

In the illustrated exemplary embodiment, spindle rod 14 is supported in a rotatably and axially immobile manner on a bearing device 20 disposed in the middle of base support 2 in order to be able to divert forces which occur during clamping onto base support 2.

Figure 2:
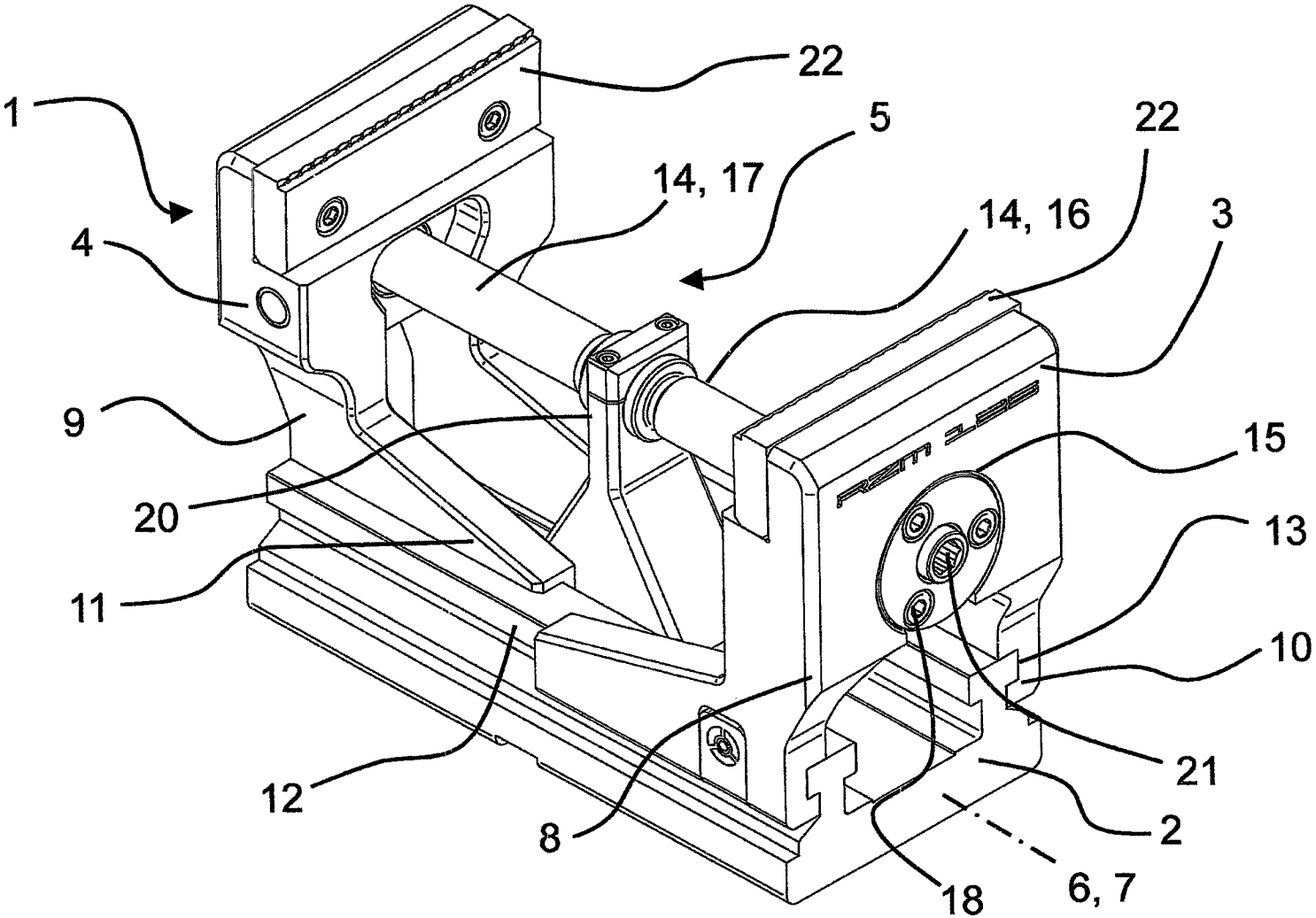
FIG. 2 show a view of FIG. 1, rotated 180 degrees.

As is apparent in FIG. 2, which shows a view which is rotated 180 degrees with respect to the view illustrated in FIG. 1, spindle rod 14 is also assigned a receptacle 21 for a tool which adjusts jaw mounts 3, 4. To actuate spindle drive 5, a suitable tool may thus be inserted into receptacle 21 for the purpose of rotating spindle rod 14. It is likewise apparent from FIG. 2 that clamping jaws 22 are assigned to jaw mounts 3, 4.

Figure 3:
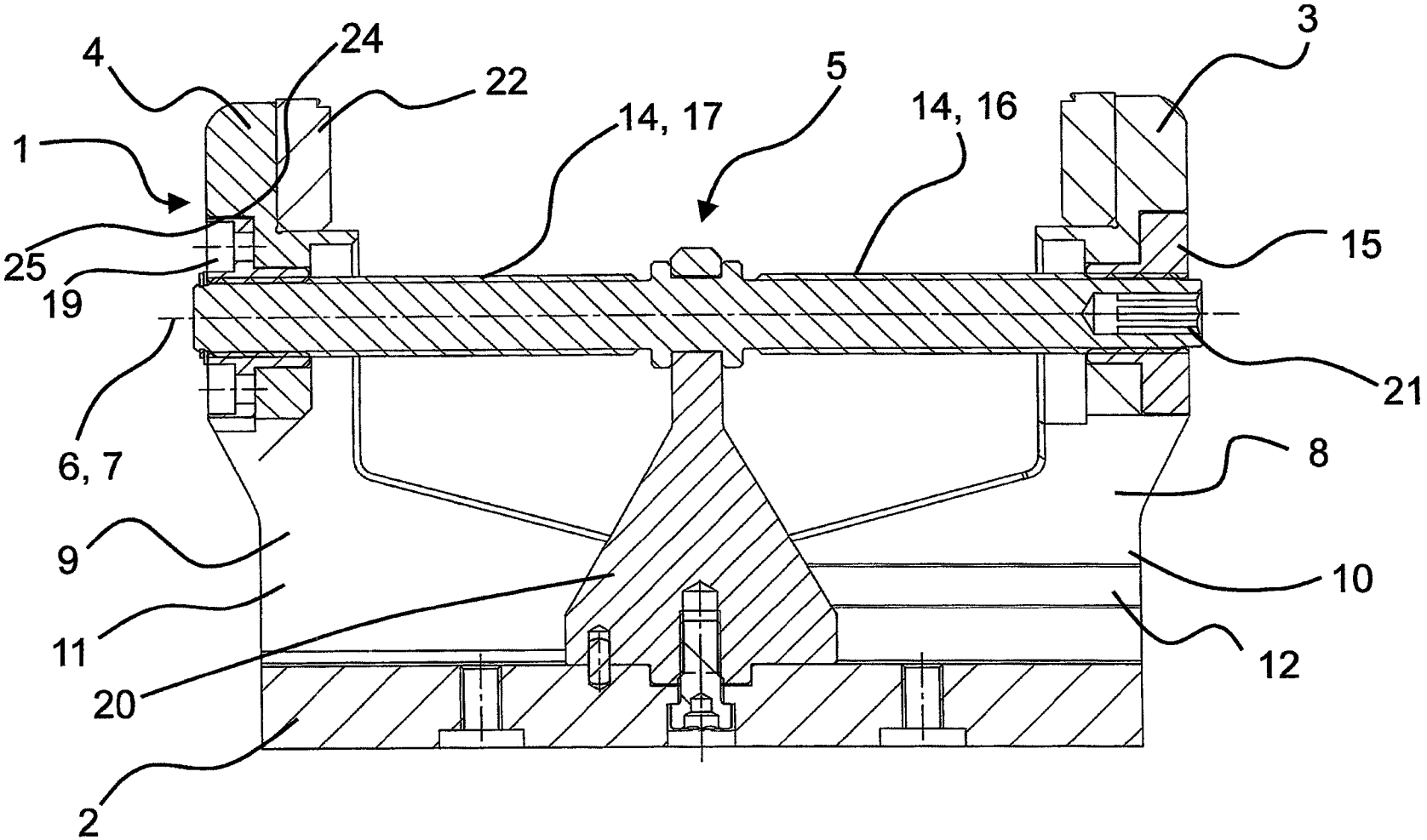
FIG. 3 shows a longitudinal sectional view along the longitudinal axis of the centric clamping vice.

The operation of spindle drive 5, in particular, is apparent from the longitudinal sectional view illustrated in FIG. 3. Due to spindle rod 14 having right-hand thread 17 and left-hand thread 16, which is supported in an rotatably and axially immobile manner on base support 2, and threaded bushings 15 which are screwed tight in jaw mounts 3, 4, jaw mounts 3, 4 may be easily adjusted simultaneously and in opposite directions when a tool is inserted into receptacle 21 of spindle rod 14, and spindle drive 5 is thus actuated.

Figure 4:
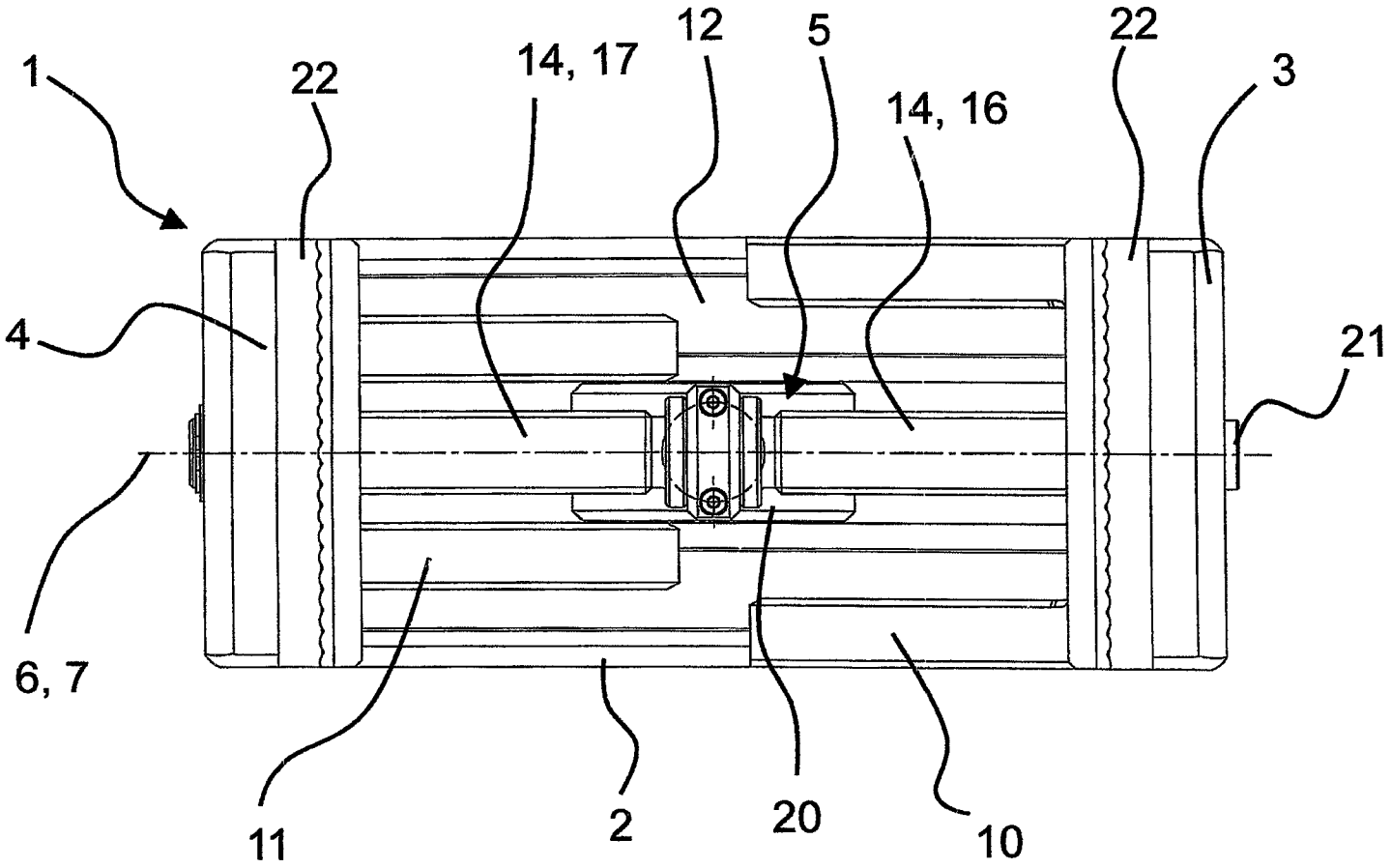
FIG. 4 shows a top view of the centric clamping vice.

The different widths of the track widths of first slides 10 and second slides 11, in particular, are apparent from the top view of centric clamping vice 1 according to the invention illustrated in FIG. 4, the track widths being selected in such a way that the difference between the track width of first slides 10 and the track width of second slides 11 is greater than the width of second slides 11. Due to the different track widths and the suitable width of second slides 11, it is possible to insert second slides 11 in to first slides 10 during an adjustment of jaw mounts 3,4 toward each other, since first slides 10 and second slides 11 do not obstruct each other, due to the different track widths. It is also apparent from the view illustrated in FIG. 4 that first slides 10 and second slides 11 have congruent center axes, which, in the exemplary embodiment illustrated, are also congruent with longitudinal axis 6.

FIG. 5 shows a perspective view of centric clamping vice 1 according to the invention, with jaw mounts 3, 4 pushed together. It is also apparent, in particular, that first slides 10 and second slides 11 may be inserted into each other, due to their different track widths, in order for clamping jaws 22 of first jaw mount 3 to be able to approach those of second jaw mount 4.

Figure 6:
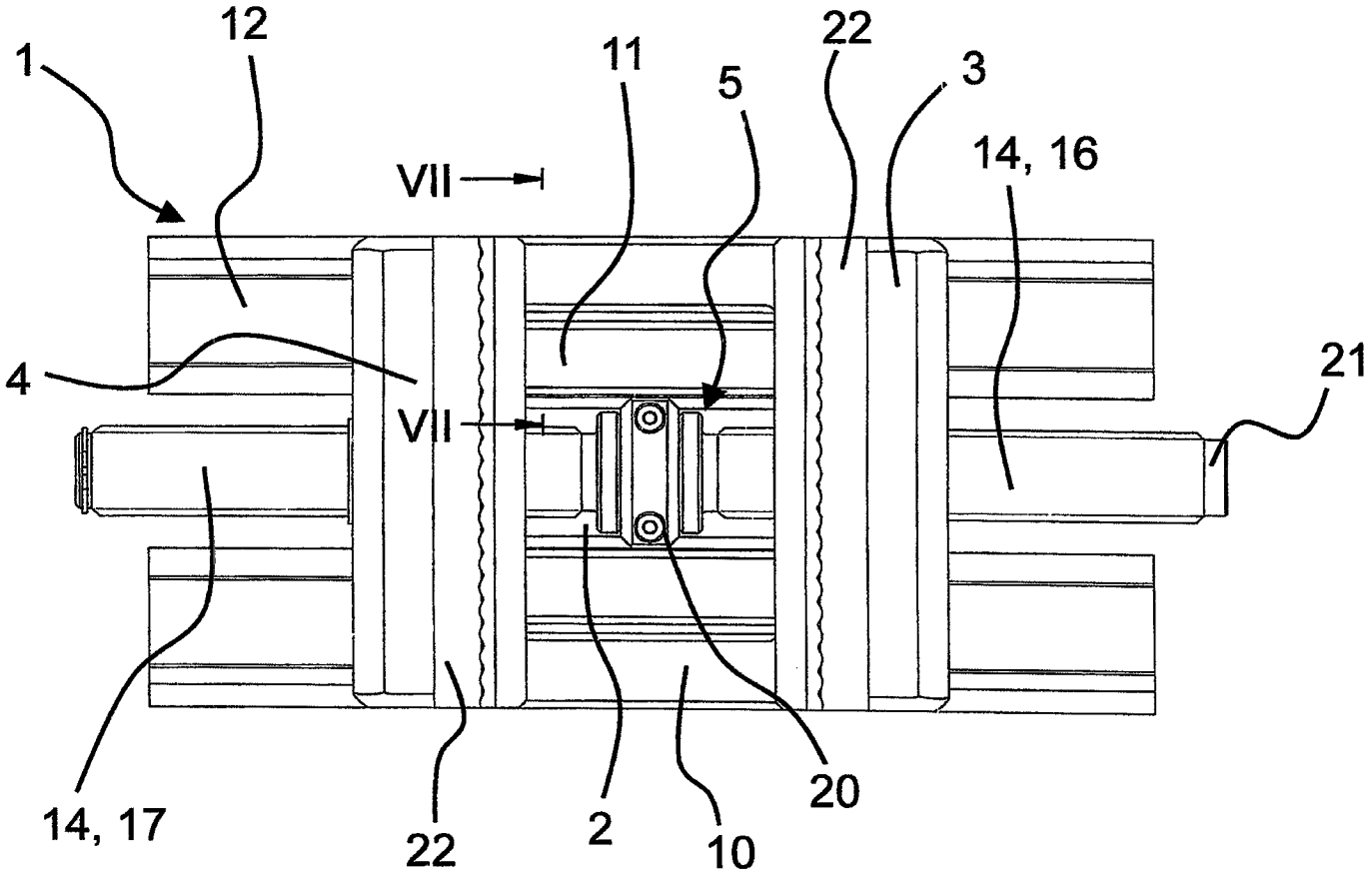
FIG. 6 shows a perspective view of the centric clamping vice, including jaw mounts partially brought together.

FIG. 6 shows a top view of centric clamping vice 1 according to the invention, with jaw supports 3, 4 partially brought together. Due to the different track widths of first slides 10 and second slides 11, a compact design of the base support is facilitated, since second slides 11 are now able to engage with first slides 10 during the actuation of spindle drive 5 and the associated movement of jaw mounts 3, 4 toward each other. In particular, it is also ensured hereby that the slides of first carriage 8 and those of second carriage 9 do not obstruct each other when they are moved along adjustment path 7. The supporting of spindle rod 14 on bearing device 20 disposed in the center of base support 2 is furthermore apparent from FIG. 6.

In FIGS. 71., 7.2. and 7.3, multiple specific embodiments of the rail 12 provided for guiding jaw mounts 3,4 are illustrated in detailed views along section VII-VII from FIG. 6.

FIG. 7.1 shows a T-shaped rail 12, on which first slide 10 is guided on the side of rail 12 facing away from longitudinal axis 6. Second slide 11, in turn is guided on the side of rail 12 facing longitudinal axis 6. Slides 10, 11 are each assigned guide grooves 13, which surround the T-shaped profile of the rail, in order to thereby limit the movement of jaw mounts 3, 4 to only one translation degree of freedom.

FIG. 7.2 shows a detailed view of a second specific embodiment of rail 12 according to the present invention. The rail has a profile which deviates from the T-shaped design illustrated in FIG. 7.1. In the exemplary embodiment shown in FIG. 7.2, both first slide 10 and second slide 11 are guided on the side of rail 12 facing away from longitudinal axis 6. For this purpose, two guide grooves 13 are provided on the side of rail 12 facing away from longitudinal axis 6, with which first slide 10 and second slide 11 may each engage, to which horizontally running guide strips 23 are assigned for this purpose. As is apparent from FIG. 7.2, the difference between the track width of first slides 10 and the track width of second slides 11 is, of course, also greater than the width of second slides 11 in the specific embodiment illustrated in FIG. 7.2.

In the third specific embodiment of rail 12 according to the invention illustrated in FIG. 7.3, only second slide 11 is guided directly on rail 12, while first slide 10 is guided on second slide 11. For the purpose of guiding second slide 11, guide strip 23, with which guide groove 13 provided in second slide 11 interacts, is assigned to rail 12 on the side facing away from longitudinal axis 6. It is also apparent from FIG. 7.3 that guide groove 13, which interacts which additional guide strip 23, which is provided on second slide 11, is also assigned to first slide 10.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A centric clamping vice for centric clamping of workpieces, the centric clamping vice comprising:

a first jaw mount;

a second jaw mount;

a base support having a longitudinal axis, on which the first jaw mount guided by a first carriage and the second jaw mount guided by a second carriage are adjustably supported along an adjustment path oriented substantially parallel to the longitudinal axis with the aid of a spindle drive;

a pair of first slides assigned to the first carriage; and a pair of second slides assigned to the second carriage, wherein a difference between a track width of the first slides and a track width of the second slides is greater than a width of the second slides.

2. The centric clamping vice according to claim 1, wherein a congruent center axis is assigned to the first slides and the second slides.

3. The centric clamping vice according to claim 1, wherein a pair of rails for guiding the first slides and/or the second slides is assigned to the base support.

4. The centric clamping vice according to claim 3, wherein the first slides are each guided on a side of the rails facing away from the longitudinal axis, and wherein the second slides are each guided on a side of the rails facing the longitudinal axis.

5. The centric clamping vice according to claim 3, wherein the rails have a T-shaped design, and wherein the first slides and the second slides are assigned corresponding guide grooves for forming a guide contact with the rails.

6. The centric clamping vice according to claim 1, wherein the spindle drive is provided by a spindle rod which has a first area with a left-hand thread and a second area with a right-hand thread, as well as by threaded bushings assigned to the first jaw mount and the second jaw mount.

7. The centric clamping vice according to claim 6, wherein a receptacle for a tool adjusting the jaw mounts is assigned to the spindle rod.

8. The centric clamping vice according to claim 6, wherein the spindle rod is supported on the base support in a rotatably and axially immobile manner.

9. The centric clamping vice according to claim 6, wherein a bearing device disposed in a center of the base support is provided for supporting the spindle rod.

10. The centric clamping vice according to claim 6, wherein a plurality of threaded receptacles for receiving screws used to fasten the threaded bushings are assigned to the first jaw mount or the second jaw mount.

11. The centric clamping vice according to claim 10, wherein radially oriented elongated holes are assigned to at least one of the threaded bushings for aligning the jaw mounts.

12. The centric clamping vice according to claim 10, wherein the number of threaded receptacles provided in the first jaw mount and/or in the second jaw mount corresponds to a multiple of the screws provided for fastening the threaded bushings.

13. The centric clamping vice according to claim 1, wherein the areas of the first carriage and the second carriage supporting the slides are beveled.

14. The centric clamping vice according to claim 1, wherein removable clamping jaws are each assigned to the first jaw mount and the second jaw mount.

* * * * *